US008656711B2

(12) United States Patent
Richter et al.

(10) Patent No.: US 8,656,711 B2
(45) Date of Patent: Feb. 25, 2014

(54) HYDRAULIC CIRCUIT FOR OPERATING A TOOL

(75) Inventors: Alfred Richter, Eisenach (DE); Frederic Lastre, Thionville (FR)

(73) Assignee: Volvo Construction Equipment AB, Eskilstuna (SE)

( * ) Notice: Subject to any disclaimer, the term of this patent is extended or adjusted under 35 U.S.C. 154(b) by 1016 days.

(21) Appl. No.: 12/524,392

(22) PCT Filed: Feb. 6, 2007

(86) PCT No.: PCT/EP2007/001014

§ 371 (c)(1), (2), (4) Date: Dec. 3, 2009

(87) PCT Pub. No.: WO2008/089794

PCT Pub. Date: Jul. 31, 2008

(65) Prior Publication Data

US 2010/0083650 A1 Apr. 8, 2010

(30) Foreign Application Priority Data

Jan. 26, 2007 (EP) ..... 07001782

(51) Int. Cl.
*F15B 13/042* (2006.01)

(52) U.S. Cl.
USPC ..... 60/433; 91/461; 91/449

(58) Field of Classification Search
USPC ..... 60/431, 420, 422, 433; 91/461
See application file for complete search history.

(56) References Cited

U.S. PATENT DOCUMENTS

| | | | | |
|---|---|---|---|---|
| 5,571,226 | A * | 11/1996 | Kobayashi | 37/348 |
| 5,791,229 | A * | 8/1998 | Lee et al. | 91/453 |
| 6,061,617 | A * | 5/2000 | Berger et al. | 701/50 |
| 6,070,516 | A * | 6/2000 | Esch et al. | 91/459 |
| 2003/0084782 | A1 | 5/2003 | Kaneda et al. | |
| 2007/0283688 | A1 * | 12/2007 | Vigholm et al. | 60/327 |

FOREIGN PATENT DOCUMENTS

| | | | |
|---|---|---|---|
| DE | 19625348 | A1 | 1/1998 |
| EP | 0218901 | A2 | 4/1987 |
| EP | 366119 | A1 * | 5/1990 |
| EP | 0366119 | A1 | 5/1990 |

OTHER PUBLICATIONS

International Preliminary Report on Patentability for corresponding International Application PCT/EP2007/001014.
International Search Report for corresponding International Application PCT/EP2007/001014.

* cited by examiner

*Primary Examiner* — Edward Look
*Assistant Examiner* — Logan Kraft
(74) *Attorney, Agent, or Firm* — WRB-IP LLP

(57) ABSTRACT

A hydraulic circuit for operating a tool is provided that is particularly useful in construction equipment such as an excavator, crane, wheel loader, drilling machine, or others. Furthermore, a control unit and a method for controlling the hydraulic circuit and construction equipment including such a hydraulic circuit is disclosed.

17 Claims, 7 Drawing Sheets

Setup a new X1 tool in IECU

It is possible to set a new tool, change or delete a tool.

Each tool can have there own name.

Set the following parameter.

Flow:

Pressure:

Operation mode:

Type of attachment:

Save all settings:

Tool is set ready to use.

After the operator can select a tool from the list.

If the operator switch on the X1 operation he will see a information screen what tool is selected.

HYDRAULIC CIRCUIT FOR OPERATING A TOOL

BACKGROUND AND SUMMARY

The invention relates to a hydraulic circuit for operating a tool especially of a construction equipment like e.g. an excavator, crane, wheel loader, drilling machine, grass cutter or others. Furthermore, the invention relates to a control unit and a method for controlling the hydraulic circuit and to a construction equipment comprising such a hydraulic circuit.

If a tool which is mounted at a construction equipment is exchanged by another tool, the operator of the construction equipment has to change and adjust accordingly the hydraulic parameter settings of the construction equipment like the pressure, the flow, the operation mode and other parameter settings which are specifically required for operating the new tool. This is usually very time consuming and implies the risk that inappropriate settings are selected by the operator.

It is desirable to provide a hydraulic circuit and a method for operating a hydraulic circuit by which this time consuming task is substantially reduced and the related risk is substantially reduced as well.

It is desirable to provide a hydraulic circuit which is simple in construction and enables to be controlled with an electronic control unit in a comparatively simple way.

According to an aspect of the invention, a hydraulic circuit is provided and, according to another aspect of the invention, a method for operating a hydraulic circuit is provided. One of the advantages of aspects of the invention is that an operator of the construction equipment is offered a high flexibility to realize settings for a plurality of different tools in an easy and quick manner.

More in detail, these solutions offer a flexible way to set and control the hydraulic circuit in a construction equipment. This is achieved especially by the fact that the settings and operating parameters of a nearly unlimited number of different tools can be programmed and stored, and then a certain tool which has been connected to the construction equipment can easily be selected by the operator, and the hydraulic parameter settings of the construction equipment for this tool can be adjusted in a quick and easy manner.

This is true for very different kinds of tools. For example, a toggle function can be realized on a related tool in an easy way. For example, a tool in the form of a hammer can be operated by the hydraulic circuit as long as a related button is pressed "on". Furthermore, for operating a related proportional tool, e.g. a proportional and progressive roller switch or a proportional foot pedal can be used in order to generate an accordingly increasing hydraulic flow or hydraulic pilot pressure for actuating the tool.

Another advantage of aspects of the invention is that a proportional foot pedal valve for the tool control can be easily included in order to keep a maximum flow limitation in both directions of the pilot pressure, wherein a de-activation function of the hydraulic circuit is kept, i.e. even if the pedal is pressed in order to operate a tool, the hydraulic circuit can be de-activated, if necessary, by means of the first proportional valve by switching the same such that substantially no hydraulic pressure is applied at its output.

Furthermore, a progressive and proportional control of the output flow of the hydraulic circuit is provided, for which only one PWM (Pulse Width Modulation) output from the control unit or ECU (Electronic Control Unit) is necessary.

BRIEF DESCRIPTION OF THE DRAWINGS

Further details, features and advantages of the invention will become apparent from the following description of exemplary and preferred embodiments of the invention in connection with the drawings, in which shows.

DETAILED DESCRIPTION

Figure 1:
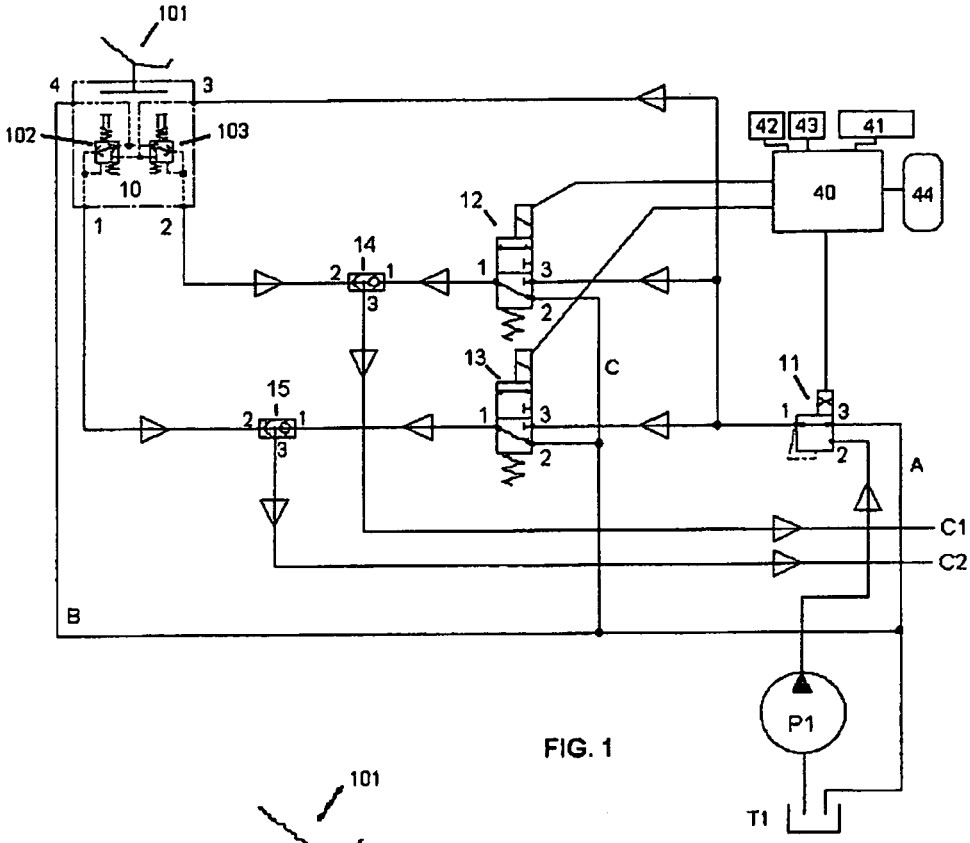
FIG. 1 shows an exemplary and preferred embodiment of a hydraulic circuit for generating a hydraulic flow or pilot pressure according to the invention to control the main pressure of a hydraulic circuit for the actuation of a tool.

FIG. 1 shows an exemplary and preferred embodiment of a hydraulic circuit according to the invention for operating or actuating a tool. The circuit is provided for setting a hydraulic flow and for generating a hydraulic pilot pressure at one or both of its output lines C1 and C2 which lines C1 and C2 are continued in FIG. 2 and are connected with a first and a second spool, respectively, of a main control valve 20 which actuates a tool 30 by means of a hydraulic main pressure in a known manner. The tool 30 operated by the hydraulic circuit according to FIG. 1 can be a one-way tool like a hammer or a two-way tool like a shear. Furthermore, the tool 30 can be a proportional tool, and it can be a tool for high pressure, high power and/or high flow (like e.g. a hammer or a shear) or a tool for low pressure, low power and/or low flow (like e.g. a rotary tool or a grass clipper).

Figure 1A:
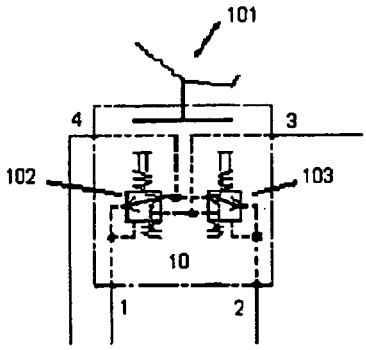

The hydraulic circuit according to FIG. 1 comprises a first proportional valve 11, a first and a second on/off valve 12, 13, each in the form of a switch-over valve, a first and a second shuttle valve 14, 15 and a pedal unit 10 (FIG. 1(A) shows an enlarged view of it) comprising a pedal 101 for actuating a second and a third proportional valve 102, 103, wherein these valves 102, 103 could alternatively be actuated by a joystick, a two-way switch or other means as well.

The first proportional valve 11 comprises a first, a second and a third port 1, 2, 3, wherein the first port 1 is proportionally switched by means of an electrical solenoid in a known manner between the second and the third port 2, 3, so that the flowing-through between the first and the second port 1, 2 continuously decreases while the flowing-through between the first and the third port 1, 3 continuously increases and vice versa.

This first proportional valve 11 is actuated by a control unit 40 in dependence on a set of stored parameters for a certain tool 30 (see FIG. 2) which has been mounted at the construction equipment and which has been selected by an operator of the construction equipment e.g. on a touch screen or a display 41 of the control unit 40, in such a way that a certain (admissible) maximum value of a hydraulic flow or hydraulic pilot pressure is applied (and will not be exceeded) at the first port 1 of the proportional valve 11, by accordingly connecting the port 3 of the valve 11 with the port 1 of the valve 11.

The first and the second on/off valve 12, 13 each comprises a first, a second and a third port 1, 2, 3, wherein the first port 1 is connected by means of an electrical solenoid in an known manner either with the second port 2 or with the third port 3.

The first and the second on/off valve 12, 13 can be switched by an operator of the construction equipment by means of a related first and second switch 42, 43, respectively, at the control unit 40. In order to operate a one-way tool 30 with one operating direction (like e.g. a hammer), one of the two valves 12, 13 is switched. In order to operate a two-way tool 30 (like e.g. a shear), one of the valves 12; 13 is switched for the operation of the tool 30 in a first direction and the other of the valves 13; 12 is switched for the operation of the tool 30 in a second direction.

The first and the second shuttle valve 14, 15 each comprises a first and a second input 1, 2 and one output 3, wherein the one input (1 or 2), at which the higher hydraulic pressure is applied in comparison to the other input, is connected with the output 3, and the other input (2 or 1) at which the lower pressure is applied is blocked. If at both inputs 1, 2 the same pressure is applied, this pressure is as well applied at the output 3.

In the second and the third proportional valve 102, 103 of the pedal unit 10, each valve has a first port which is proportionally switched between a second and a third port, as described above with reference to the first proportional valve 11. However, the second and the third proportional valve 102, 103 are alternatively actuated by means of the pedal 101 in a known manner, i.e. the second valve 102 is actuated by pressing the pedal 101 down in the forward direction (counter-clockwise in FIG. 1) while the third valve 103 is not actuated during this operation, and the third valve 103 is actuated by pressing the pedal 101 down in the backward direction (clockwise in FIG. 1) while the second valve 102 is not actuated during this operation. In case the pedal 101 is in the neutral position as shown in FIG. 1 both valves 102, 102 are in a non-actuated position as well.

The pedal unit 10 comprising the second and the third proportional valve 102, 103 comprises a first port 1, to which the first port of the second proportional valve 102 is connected, a second port 2, to which the first port of the third proportional valve 103 is connected, a third port 3, to which the second port of the second and of the third proportional valve 102, 103 is, connected, and a fourth port 4, to which the third port of the second and of the third proportional valve 102, 103 is connected.

The second and the third proportional valve 102, 103 are alternatively operated by an operator of the related construction equipment by means of the pedal 101 (or another means as mentioned above) in order to proportionally operate a related tool 30 (see FIG. 2) mounted at the construction equipment.

The hydraulic circuit is supplied with hydraulic pilot pressure by means of a first pilot pressure source, e.g. a pump P1 for feeding pressurized hydraulic fluid (typically with a pressure of about 35 to 40 bar) from a first tank T1 to the second port 2 of the first proportional valve 11. A first back or return flow line A into the first tank T1 is connected with the third port 3 of the first proportional valve 11. This line A is as usual substantially "pressure-less" in that its pressure is about equal to the atmospheric pressure of the surroundings.

The first port 1 of the first proportional valve 11 is connected with the third port 3 of the first on/off valve 12, with the third port 3 of the second on/off valve 13 and with the third port 3 of the pedal unit 10.

The fourth port 4 of the pedal unit 10 is connected via a second back or return flow line B with the first tank T1. This line B is as usual substantially "pressureless" in that its pressure is about equal to the atmospheric pressure of the surroundings.

The second port 2 of the first on/off valve 12 and the second port 2 of the second on/off valve 13 are connected with a third back or return flow line C which is leading into the first tank T1. This line C is as usual substantially "pressureless" in that its pressure is about equal to the atmospheric pressure of the surroundings.

The first port 1 of the first on/off valve 12 is connected with a first input 1 of the first shuttle valve 14 and the first port 1 of the second on/off valve 13 is connected with a first input 1 of the second shuttle valve 15.

The second input 2 of the first shuttle valve 14 is connected with the second port 2 of the pedal unit 10, whereas the second input 2 of the second shuttle valve 15 is connected with the first port 1 of the pedal unit 10.

The output 3 of the first shuttle valve 14 is connected with the first output line C1 and the output 3 of the second shuttle valve 15 is connected with the second output line C2 of the hydraulic circuit.

Figure 2:
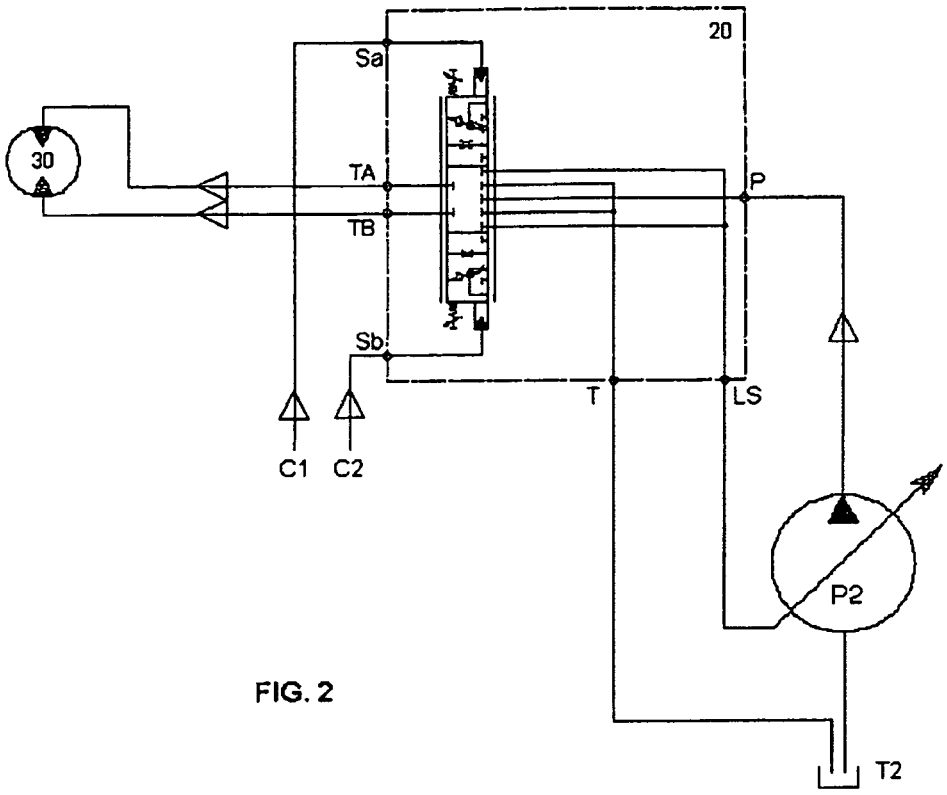
FIG. 2 is a schematic illustration of a hydraulic circuit for generating a hydraulic main pressure for the actuation of a tool.

The hydraulic flows or hydraulic (pilot) pressures generated at these two output lines C1, C2 are fed according to FIG. 2 to the spool of a main control valve 20 in order to convert the flow or pressure values in a known manner to a certain flow of hydraulic fluid or main pressure by which the tool 30 is actuated.

More in detail, the first output line C1 is connected via a first input terminal Sa of the main control valve 20 with the first spool, and the second output line C2 is connected via a second input terminal Sb of the main control valve 20 with the second, opposite spool.

For generating the main pressure for actuating the tool 30, a second pressure source, e.g. a pump P2 is provided for feeding a hydraulic fluid from a second tank T2 (wherein the first and the second tank Ti, T2 is usually one common tank) via a third input terminal P to the main control valve 20. This second pump P2 is controlled according to the operation of the spools via a fourth terminal LS, and a back or return flow line into the second tank T2 is provided via a fifth terminal T of the main control valve 20. This back or return flow line is as usual substantially "pressure-less" in that its pressure is about equal to the atmospheric pressure of the surroundings.

The operation of a main control valve 20 according to FIG. 2 by feeding the right and the left side of the spool with the hydraulic flow or hydraulic pressure via the output lines C1 and C2, respectively, in order to supply the required hydraulic main pressure via a first and a second output terminal TA, TB for actuating the tool 30 is generally known so that it need not to be described here.

Figure 6:
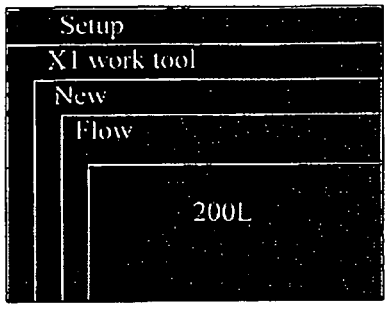
FIG. 6 schematic displays for setting certain parameters.
Figure 6:
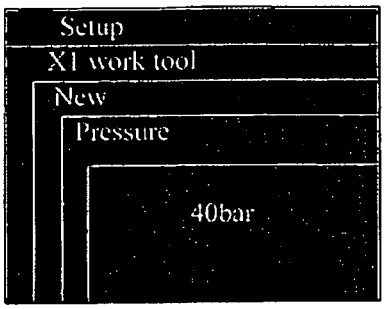
Figure 6:
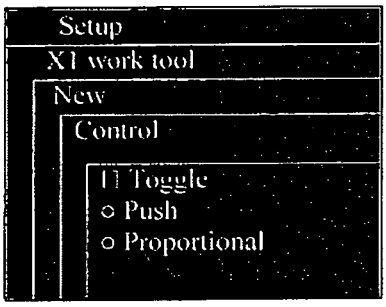
Figure 6:
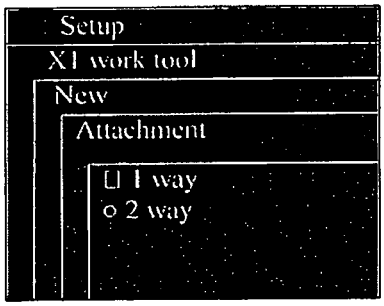
Figure 6:
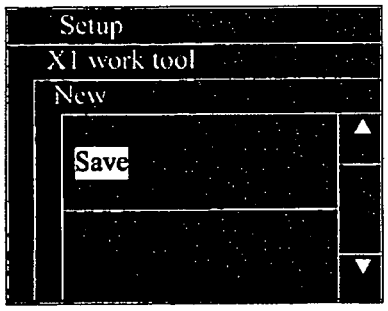
Figure 6:
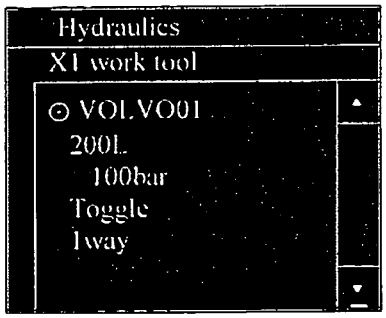
Figure 7:
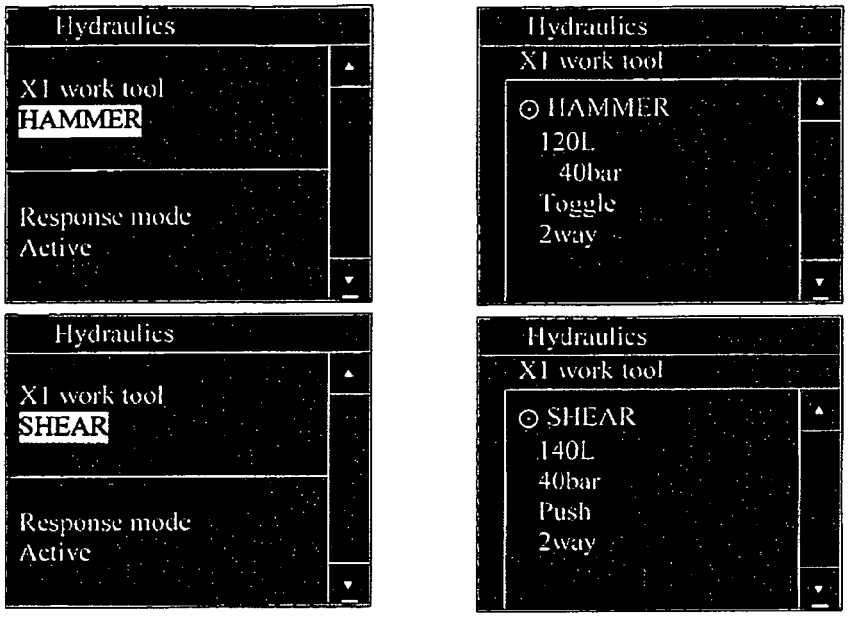
FIG. 7 schematic displays for selecting a certain tool from a saved list of tools.
Figure 7:
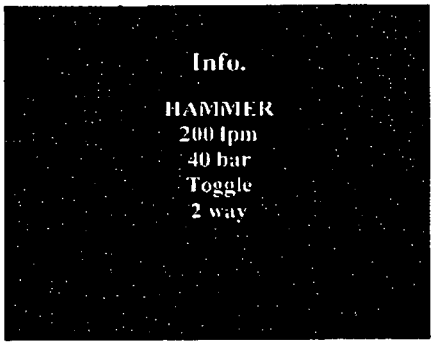

In the following, the generation of the hydraulic flow or hydraulic pilot pressure which is supplied to the spool via the first and the second output line C1, C2 shall be described with reference to FIG. 1 and the displays shown in FIGS. 5 to 7.

After mounting a certain work tool 30 at the construction equipment, the operator starts a first setup sequence for this tool 30 by selecting on the display (or a touch screen) 41 a tool setup menu. By this, a list of stored tools appears on the display 41. From this list the operator selects the tool 30 which is mounted at the construction equipment. Then, another list with the stored parameter settings for this selected tool, like the flow value, the pressure value, the kind of tool (one-way or two-way tool) and the kind of control of the tool (like on/off, push, toggle or proportional operation) is indicated on the display 41. Then, the control unit 40 (or a VECU (Vehicle Electronic Control Unit) to which these parameter settings are submitted) adjusts the first proportional valve 11 such that a maximum admissible hydraulic flow or pilot pressure which corresponds to the stored parameter settings for the mounted tool 30 is applied (and will not be exceeded) at the first port 1 of the first proportional valve 11 by accordingly actuating this valve 11 by means of its solenoid.

If the parameter settings of the tool 30 which is mounted at the construction equipment are not stored in the control unit 40 so that the operator cannot find the tool 30 in the list of stored tools, he has the opportunity to store the required parameter settings of the new tool by starting a related second sequence. In such a second sequence, the operator selects on the display (or a touch screen) 41 a related setup menu for a new tool, in which he inputs a name for the new tool and the required settings for this tool like the flow value, the pressure value, the kind of tool (one-way or two-way tool) and the kind of control of the tool (like on/off, push, toggle or proportional operation). Thereafter, he can store these settings under the name of the new tool, so that the new tool is available in the list of stored tools when the first setup sequence is started the next time.

Figure 3:
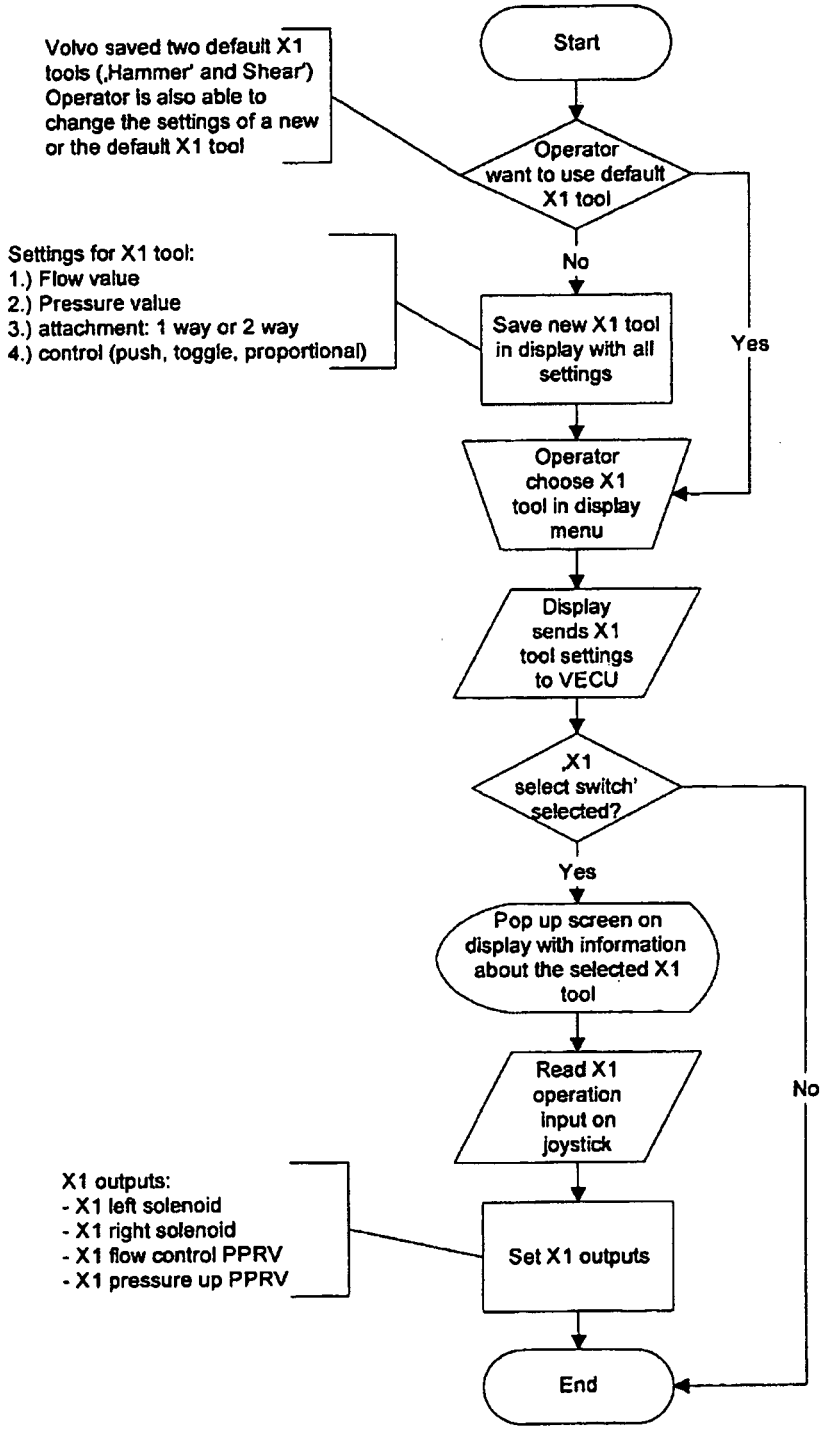
FIG. 3 an first exemplary flowchart for settings in a display for X1 function for parameters of a first tool according to the invention.
Figure 4:
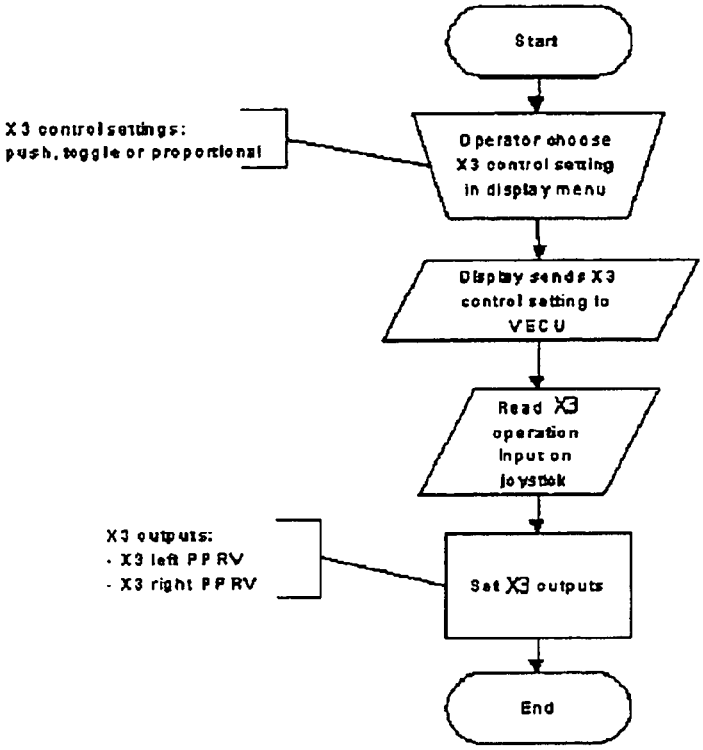
FIG. 4 a second exemplary flowchart for settings in a display for X3 function for parameters of a second tool according to the invention.

In both cases, the X1 function indicates a high pressure, high power, high flow tool like e.g. a shear or a hammer, and the X3 function indicates a low pressure, low power, low flow tool like e.g. a rotary tool. A flowchart for settings in a display for the X1 function is shown in FIG. 3, a flowchart for settings in a display for the X3 function is indicated in FIG. 4.

Figure 5:
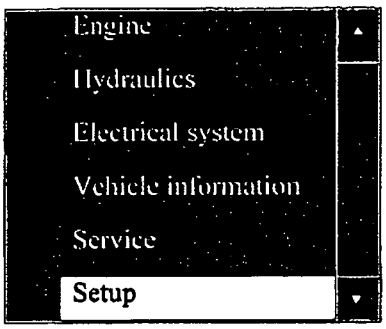
FIG. 5 schematic displays for setting up a new X1 tool in the IECU.
Figure 5:
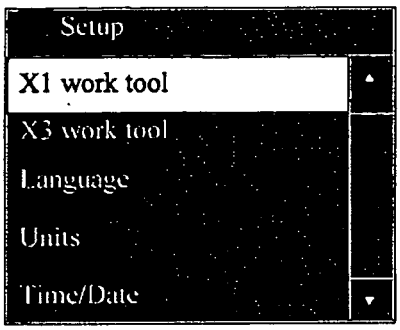
Figure 5:
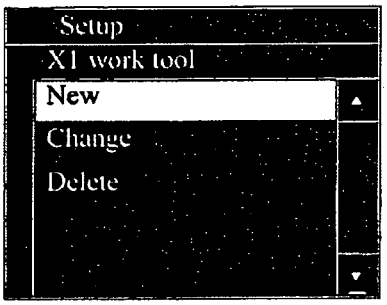
Figure 5:
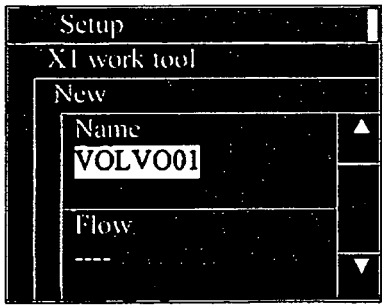

FIG. 5 exemplarily shows four displays during a setup of a new X1 tool in the control unit 40. FIG. 6 exemplarily shows four displays for setting the parameters: flow, pressure, operation mode, type of attachment, respectively, furthermore one display for the saving of all of these settings and another display with an overview of the selected parameters for the tool which is now ready for use. Finally, FIG. 7 exemplarily shows how an operator can select a tool from a list of tools and the related parameters as stored, respectively, and another display in the form of an information screen regarding the selected tool if the operator switches on the X1 operation.

After the first proportional valve 11 has been adjusted by the control unit 40 to the tool as mentioned above such that at its first port 1 the maximum admissible flow or pilot pressure for the tool mounted at the construction equipment is applied (and will not be exceeded), the operator can start operating the tool without running the risk to expose the tool to operational modes and hydraulic pressures outside the normal mode of operation and outside to admissible pressure range which would damage the tool.

If a one-way tool 30 is mounted at the construction equipment, this tool is operated by actuating the first or the second on/off valve 12, 13 by means of the related first or second switch 42, 43 in dependence, on which output line C1 or C2 the hydraulic pilot pressure is needed for operating the one-way tool.

If for example the hydraulic pilot pressure for operating the tool is needed on the first output line C1, the first on/off valve 12 is switched from its off position shown in FIG. 1 into its on position, so that the hydraulic pilot pressure at the first output 1 of the first proportional valve 11 is supplied through the first on/off valve 12 and the first shuttle valve 14 to the first output line C1. If e.g. the one-way tool 30 connected with the main control valve 20 is a hammer, the hammer is on when pressing down or pushing the first switch 42, and the hammer is off when the first switch 42 is released ("one-way push tool").

In case of a two-way push tool, both switches 42, 43 and accordingly both the first and the second on/off valves 12, 13 are accordingly used for actuating the tool in a first and a second direction, respectively.

More in detail, if the tool 30 mounted at the construction equipment is a two way tool like a shear the operator (i) actuates the first on/off valve 12 (by switching it from its off position shown in FIG. 1 into its on position) by pressing the first switch 42 for operating the shear in one direction (e.g. opening the shear) while the second on/off valve 13 is in its off position during this time, and (ii) actuates the second on/off valve 13 (by switching it from its off position shown in FIG. 1 into its on position) by pressing the second switch 43 for operating the shear in the opposite direction (e.g. closing the shear) while the first valve 12 is in its off position during this time. In other words, the actuation of the first and the second on/off valve 12, 13 controls the exertion of pressure onto the left and the right side of the spool, respectively, of the main control valve 20.

Other tools ("toggle tools") start running when one switch 42 (or 43) is pressed a first time, and stop running when the switch 42 (or 43) is pressed a second time.

If the tool 30 mounted at the construction equipment is a tool which is to be proportionally controlled by a proportional flow or pilot pressure, the related maximum (admissible) hydraulic pilot pressure or flow which is applied according to the parameter setup of the tool as explained above at the first port 1 of the first proportional valve 11 is proportionally reduced by means of at least one of the second and third proportional valve 102, 103 of the pedal unit 10. In case of operating such a tool, the first and the second on/off valve 12, 13 remain in their closed position as shown in FIG. 1, in which each first port 1 is connected with the third back or return flow line C leading into the first tank Ti, so that a substantially zero (i.e. atmospheric) pressure is applied at the first ports 1 of the first and the second on/off valve 12, 13.

In the non-actuated position of the pedal 101 as shown in FIG. 1, the first and the second port 1, 2 of the pedal unit 10 are connected with the fourth port 4. The fourth port 4 is connected by means of the second back or return flow line B with the first tank Ti so that a substantially zero (i.e. atmospheric) hydraulic pressure is applied at the first and the second port 1, 2 of the pedal unit 10 and accordingly at both output lines C1, C2.

If for example the second proportional valve 102 of the pedal unit 10 is actuated by tilting the pedal 101 forwardly (in FIG. 1: tilting it counterclockwise, whereby the third proportional valve 103 is not actuated), the first port 1 of the pedal unit 10 is proportionally connected with the third port 3 of the pedal unit 10. By this, the maximum (admissible) hydraulic pilot pressure which is supplied from the first port 1 of the first proportional valve 11 to the third port 3 of the pedal unit 10, is proportionally reduced and supplied from the first port 1 of the pedal unit 10 to the second output line C2.

If the third proportional valve 103 of the pedal unit 10 is actuated by tilting the pedal 101 backwardly (in FIG. 1: tilting it clockwise, whereby the second proportional valve 102 is not actuated), the second port 2 of the pedal unit 10 is proportionally connected with the third port 3 of the pedal unit 10, so that an accordingly reduced maximum (admissible) hydraulic pilot pressure is supplied from the first port 1 of the first proportional valve 11 via the third and the second port 3, 2 of the pedal unit 10 to of the first output line C1.

By these proportionally reduced pilot pressures at the first and the second output line C1, C2, the tool 30 is proportionally actuated in a first and a second direction, respectively.

If a proportional tool 30 (like e.g. a rotary tool) is operated by the operator by means a roller switch 44 instead of by means of the pedal unit 10, then the first proportional valve 11 is proportionally actuated by the control unit 40 such that it as well generates a respective proportional hydraulic flow or pilot pressure (up to the maximum admissible flow or pressure value for that tool) according to the actuation, especially the stroke, of the roller switch 44, instead of the actuation of the (pressure reducing) proportional valves 102, 103 of the pedal unit 10. Furthermore, in dependence on the direction in which the roller switch 44 is rolled, either the first or the second on/off valve 12, 13 is opened by the control unit 40.

Summarizing the above, the first proportional valve 11 is used for the following three functions:

1. Disengaging the hydraulic flow or pressure to the output lines C1, C2 by reducing the pilot pressure to a value which is zero or at least below the cracking point of the spool of the main control valve 20;
2. Limiting the maximum pilot pressure or flow to an admissible value which is set by the control unit 40 or the operator when operating a certain tool 30;
3. Controlling the pilot pressure or flow in a dynamic way for proportionally controlling a related proportional tool 30.

For disabling the hydraulic circuit, the first proportional valve 11 is actuated into the position as shown in FIG. 1, in which the first port 1 is fully connected with the third port 3 which is connected via the first back or return flow line A with the first tank Tï so that a substantially zero pressure (or, more precise, atmospheric pressure) is applied at the first port 1 of the first proportional valve 11.

Finally, it shall be mentioned, that for one or more of the tools 30 each more than one set of parameter settings or operation modes (like proportional control, push or toggle modes) can be stored in the control unit 40, which parameter settings or modes can accordingly be selected by an operator of the construction equipment in dependence on e.g. a certain task or work which has to be done by means of the tool.

In total, the hydraulic circuit according to the invention as indicated in FIG. 1 is provided in an advantageous way for three different functions, namely to deactivate the hydraulic circuit if necessary, to control the maximum hydraulic flow or hydraulic pilot pressure which can be supplied to a certain mounted tool and to control the tool, especially a proportional tool, in a dynamic way.

The control unit 40 may be in the form of a computer and comprise a computer program code adapted to perform a method or for use in a method for controlling the hydraulic circuit, where the method includes a first step of receiving an input, made by a user, indicating a selected tool, and a second step of generating an output signal for actuating the first proportional valve in dependence on stored settings for the selected tool. The computer program may be downloaded to the control unit or one of its components when it is connected to the internet. A computer program product stored on a non-transitory computer readable medium can be provided comprising a program code for use in such a method.

The invention claimed is:

1. A hydraulic circuit adapted for use in construction equipment for generating a hydraulic pressure for operating a tool of the construction equipment, comprising:

a first proportional pressure reducing valve for generating a pre-selected maximum hydraulic flow or hydraulic pressure for the tool, at least one on/off valve, and at least one second proportional valve, wherein the first proportional valve and the at least one on/off valve are connected in series between a first pressure source and at least one output line being provided for operating the tool, and the at least one second proportional valve is connected in series between the first proportional valve and the at least one output line and in parallel with the at least one on/off valve.

2. A hydraulic circuit according to claim 1, wherein the at least one on/off valve can be switched by an operator for operating the tool.

3. A hydraulic circuit according to claim 1, wherein the pre-selected maximum hydraulic, flow or hydraulic pressure is a pilot pressure and the first pressure source is a pilot pressure source and wherein the at least one output line is fed to a spool of a main control valve for converting the hydraulic flow or hydraulic pilot pressure to a hydraulic flow or hydraulic main pressure by which the tool is operated.

4. A hydraulic circuit according to claim 1, wherein a first output line and a second output line is provided for being connected with a first and a second side, respectively, of a spool of a main control valve for operating the tool.

5. A hydraulic circuit according to claim 4, wherein a first on/off valve is provided in the first output line and a second on/off valve is provided in the second output line.

6. A hydraulic circuit according to claim 1, wherein between the at least one on/off valve and the at least one second proportional valve at least one shuttle valve is provided, the output of which is connected with the at least one output line.

7. A hydraulic circuit according to claim 1, wherein the first proportional valve is actuated by means of an electrical solenoid which is controlled by means of a control unit in which a plurality of parameter settings for a plurality of tools to be operated by the hydraulic circuit is stored.

8. A hydraulic, circuit according to claim 7, wherein the control unit is provided for receiving predetermined parameter settings for a plurality of tools by means of an input device and for storing these predetermined parameter settings.

9. A hydraulic circuit according to claim 7, wherein the control unit is provided with an input device and provided for controlling the first proportional valve in dependence on an actuation of the input device by an operator of the construction equipment, in order to operate a tool in than of a proportional tool.

10. A hydraulic circuit according to claim 1, wherein the at least one on/off valve is actuated by an operator of the construction equipment in order to operate a tool in form of a one-way or a two-way tool.

11. A hydraulic circuit according to claim 1, wherein the at least one second proportional valve is actuated by an operator of the construction equipment in order to operate a tool in form of a proportional tool.

12. A method for controlling, the hydraulic circuit according to claim 1, comprising a first step of receiving an input, made by a user, indicating a selected tool, and a second step of generating an output signal for actuating the first proportional valve in dependence on stored settings for the selected tool.

13. Computer comprising a computer program code adapted to perform a method or for use in a method according to claim 12.

14. Computer according to claim 13 adapted to download the computer program to the computer or one of its components when the computer is connected to the interact.

15. Computer program product stored on a non-transitory computer readable medium, comprising a program code for use in a method according to claim 12.

16. A control unit for actuating the first proportional valve in a hydraulic circuit according to claim 1 in dependence on stored parameter settings for a user selected tool.

17. Construction equipment comprising a hydraulic circuit according to claim 1.

* * * * *